US005884781A

United States Patent [19]

Ehrhart

[11] Patent Number: 5,884,781

[45] Date of Patent: Mar. 23, 1999

[54] SKI HOLDING DEVICE

[76] Inventor: Kurt J. Ehrhart, 85 High St., Milford, Conn. 06460

[21] Appl. No.: 990,728

[22] Filed: Dec. 15, 1997

[51] Int. Cl.[6] ..... A47F 7/00

[52] U.S. Cl. ..... 211/70.5; 211/85.7; 211/60.1; 211/89.01; D6/552

[58] Field of Search ..... 211/85.7, 70.5, 211/99, 100, 87.01, 60.1, 89.01; D6/552

[56] References Cited

U.S. PATENT DOCUMENTS 2,956,812 10/1960 Lundquist .
3,421,725 1/1969 Glass .
4,635,800 1/1987 Stempin .
4,763,797 8/1988 Egan ..... 211/89.01 X
4,793,496 12/1988 Wait .
4,798,298 1/1989 Ursetta ..... 211/70.5
5,193,694 3/1993 Wave .
5,417,335 5/1995 White .

*Primary Examiner*—Robert W. Gibson, Jr.
*Attorney, Agent, or Firm*—Robert H. Montgomery

[57] ABSTRACT

A ski holding and storage device comprising a first wall mounted member for vertically supporting skis and a second member pivotally mounted to the wall mounted member for retaining skis on said first member. The wall mounted member has short support lugs extending therefrom to provide support for the skis on the upwardly curved leading tips of the skis. The pivotal retaining member retains the skis on the support lugs and provides facility for supporting other equipment such as ski poles.

5 Claims, 3 Drawing Sheets

SKI HOLDING DEVICE

FIELD OF THE INVENTION

This invention relates to a wall mounted ski supporting and holding device for storing skis when not in use.

BACKGROUND OF THE INVENTION

Storage of skis and ski equipment when not in use has been recognized as a concern, if not a problem. This had led to the suggestion of many wall mounted racks, clips or slings which include a base or mounting affixed to a wall with horizontally projecting supports which engage and support a pair of skis in bottom-to-bottom contact.

Skis, by inherent design, include an upwardly arc or arcuate leading or front tip portion which contribute to placement and support of a pair of skis in bottom-to-bottom relationship by the horizontally projecting supports engaging the skis in the arcuate leading portion. The projecting supports are spaced to engage and support the skis by engaging the skis above the point of tangency where the arcuate portion of the front tip begins. Examples of such ski holders are shown in U.S. Pat. Nos. 2,956,812; 4,793,496; 5,193,694; and 5,417,335.

It is further general practice to secure a pair of skis together in bottom-to-bottom relationship by interlocking the ski brakes intermediate the ends of the skis as shown in U.S. Pat. Nos. 4,793,496 and 5,193,694. This securing method is almost general practice no matter how the skis are stored.

U.S. Pat. No. 4,635,800 discloses a wall mounted ski holder where a retaining element is bent upwardly from a base to receive and support skis at the upper arcuate leading tips from the outside (with respect to a wall) edges of the skis.

Ski holders of the type described present a problem in that the outward projecting support members extend from the mounting wall at substantially eye or facial level and may present a hazard to a person working near the mounting wall.

Additionally, the ski holder of U.S. Pat. No. 4,635,800 requires that the rear ends of the skis engage a lower support surface. Also, the holding element which is integral with the mounting is subject to fatigue and cracking from repeated bending to receive a pair of skis.

Accordingly, the present invention provides a new and improved holding device for mounting on a wall which extends only a minimal distance from a wall and includes a retaining member pivotally mounted to a wall support member which engages the outside edges of a pair of skis to retain them on small support lugs extending from the wall support member. This construction provides positive support of the skis on the lugs and retention of the skis on the lugs. When not in use, the retaining member pivots flush against the mounting wall. A device embodying completely supports and retains skis without a lower support device or floor mounting and, therefore, may be wall mounted above normal facial and head level.

An object of this invention is to provide a new and improved wall mounted device for supporting skis.

Another object of this invention is to provide a new and improved ski holding device of the type described which is easily installed, has a long life and which may be wall mounted above normal head level.

A further object of this invention is to provide a new and improved ski holding device of the type described which also has facility for holding ski poles.

A still further object of this invention is to provide a new and improved ski holding device of the type described which mounts flush to a wall and has minimal extension from the wall when not in use.

A still further object of this invention is to provide a new and improved wall mounted ski holding device of the type described which requires no bottom support for the skis.

SUMMARY OF THE INVENTION

Briefly stated, the invention, in one form thereof, comprises a ski holding and storage device which preferably comprises two parts of molded plastic material. The first part is a wall mounted member having short supporting lugs extending therefrom to provide support for a pair of skis. The second part is a retaining member pivoted to the wall mounted support member which retains skis on the wall mounted member and also provides support for other ski equipment such as poles. The wall mounted member provides the principal support for the skis, while the retaining member retains the skis on the supports of the wall mounted member. When not supporting skis, the device is essentially flush with the mounting wall and presents no obstruction to a person passing or working near the wall.

The features of the invention which are believed to be novel are particularly pointed out and distinctly claimed in the concluding portion of this specification. The invention, however, together with further objects and advantages may best be appreciated by reference to the following description taken in conjunction with the drawings.

DETAILED DESCRIPTION OF THE DRAWINGS

DESCRIPTION OF PREFERRED EMBODIMENT

Figure 4:
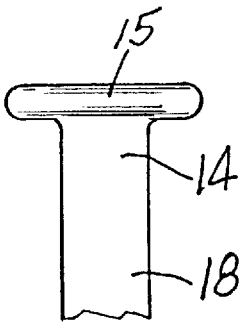
FIG. 4 is a fragmentary view of a portion of FIG. 1.

A device 10 embodying the invention comprises a wall mounting member 11 and a ski and equipment retaining member 12. Mounting member 11 has three apertures 13 defined therein to receive screws or other devices for wall fastening. Retaining member 12 has at one end 14 thereof an integral hinge pin 15 (see also FIG. 4).

Figure 3:
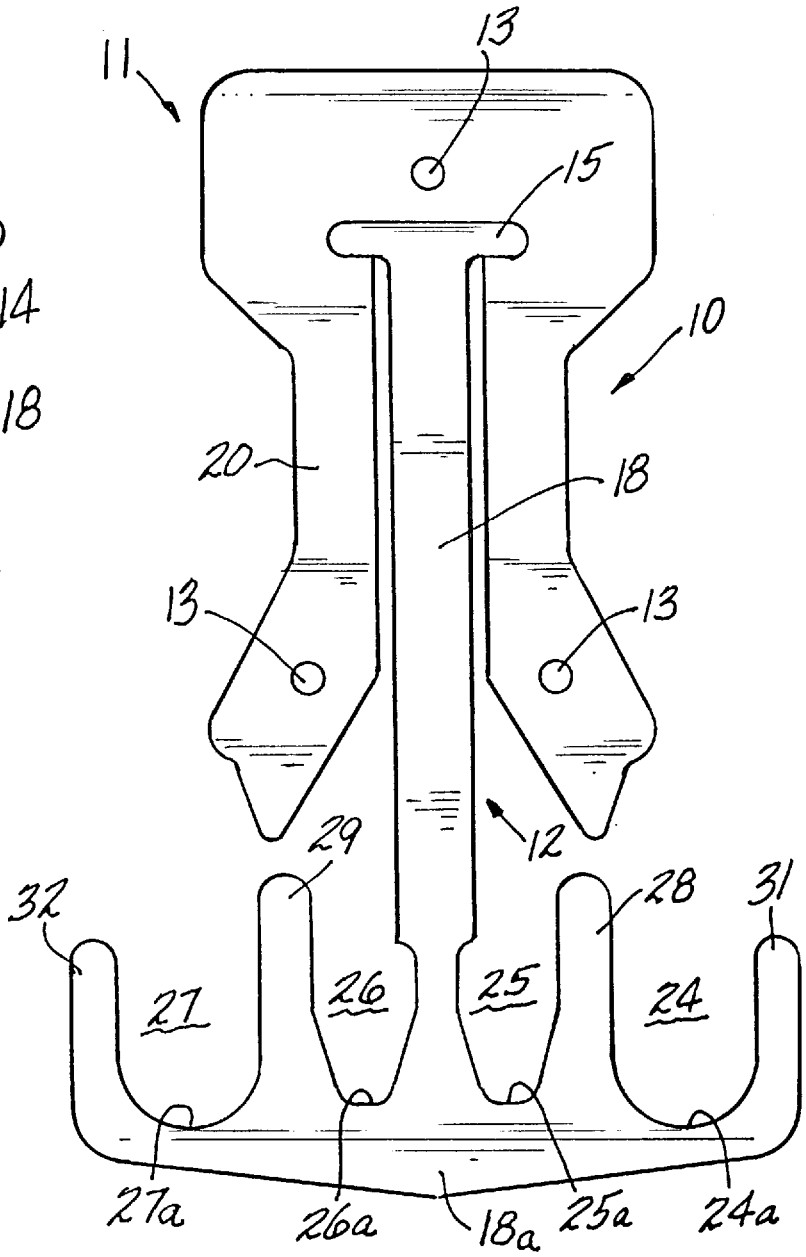
FIG. 3 is a back elevational view of the device of FIG. 1.

Member 11 has formed thereon toward the upper end a housing 16 which defines a hollow bearing 17 for hinge pine 15. Bearing 17 is open from the back surface of member 11 (see FIG. 3) to receive hinge pin 15. When member 11 is wall mounted, hinge pin 15 is captured in bearing 17.

Retaining member 12 further includes an arm 18 with a cross portion 18*a* at the end opposite hinge pin 15. Retaining member 15 is of a general inverted T-shape.

Mounting member has downwardly directed arms 19 and 20 defining a space therebetween which receives arm 18 therebetween. In an inoperative condition arm 18 will rest against the mounting wall or mounting surface.

Figure 1:
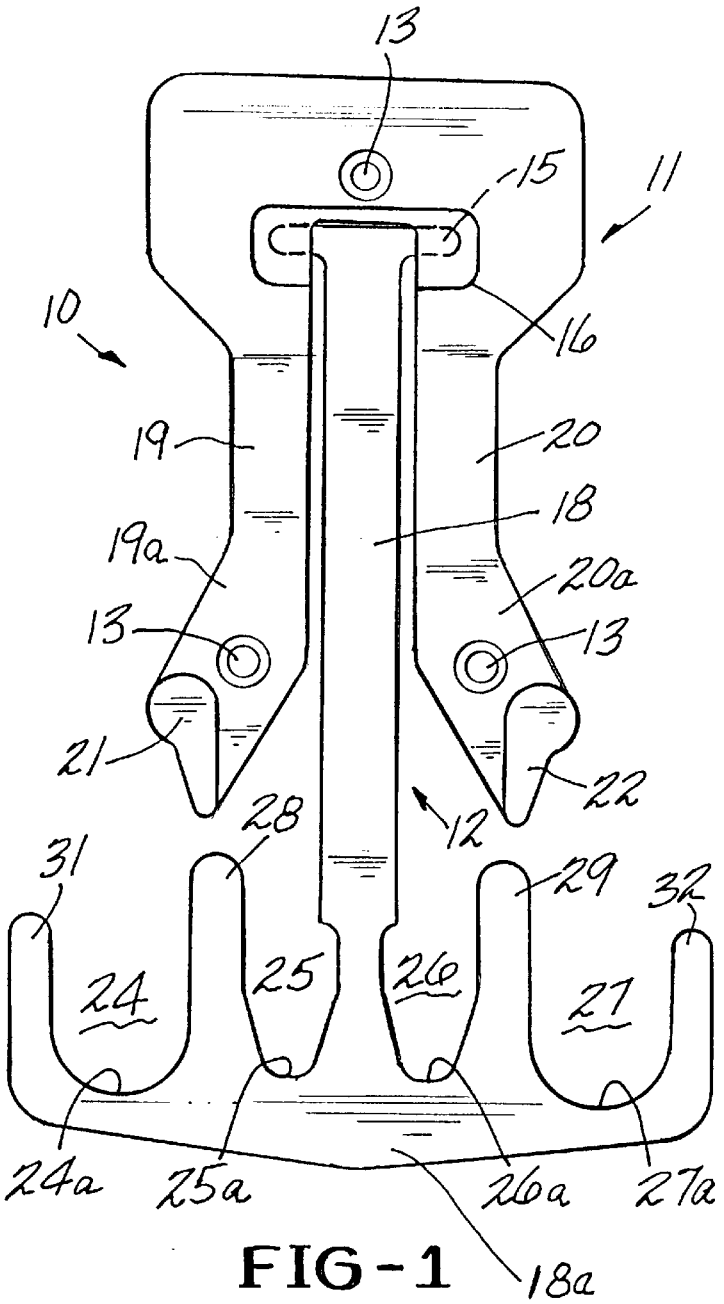
FIG. 1 is a front elevational view of a device embodying the invention.
Figure 2:
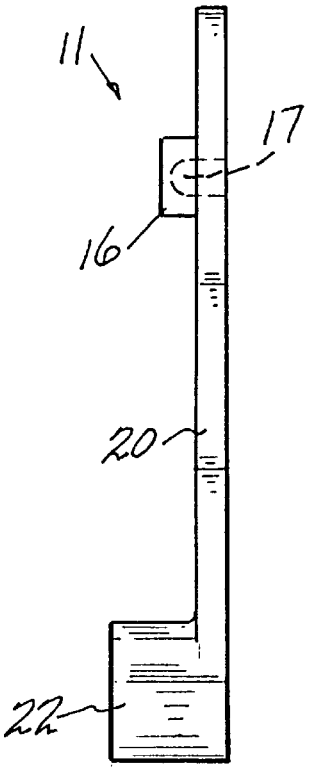
FIG. 2 is a side elevational view of a wall mounting member of the device of FIG. 1.

At the lower ends of arms 19 and 20 are projecting support lugs 21 and 22, respectively, as shown in FIG. 1, while only lug 22 is shown in FIG. 2. The lugs 21 and 22 are made arcuate on the inner upper edges where they will be contacted by the outwardly curving arcuate portions of the leading tips of the skis when in bottom-to-bottom contact.

The lugs 21 and 22 are spaced a distance so that the curved inside surface of the lugs will engage the curved leading edges of the skis on the upper (normally) surfaces and permit arm 18 to pivot downwardly therebetween. The areas of contact of lugs 21 and 22 with different skis may vary dependent on the curvature of the ski tips.

To provide this spacing of lugs 21 and 22 arms 19 and 20 of member 11 diverge outwardly at the lower ends thereof as shown at 19*a* and 20*a*, respectively.

The end or cross portion 18*a* of hinged portion 12 defines four recesses 24, 25, 26 and 27. As hereinafter described recess 25 defined between arm 18 and finger 28 and recess 26 defined between arm 18 and finger 29 serve to retain a pair of skis on support lugs 21 and 22. Recess 24 defined by fingers 28 and 31 and recess 27 defined by fingers 29 and 32 receive ski poles.

Figure 5:
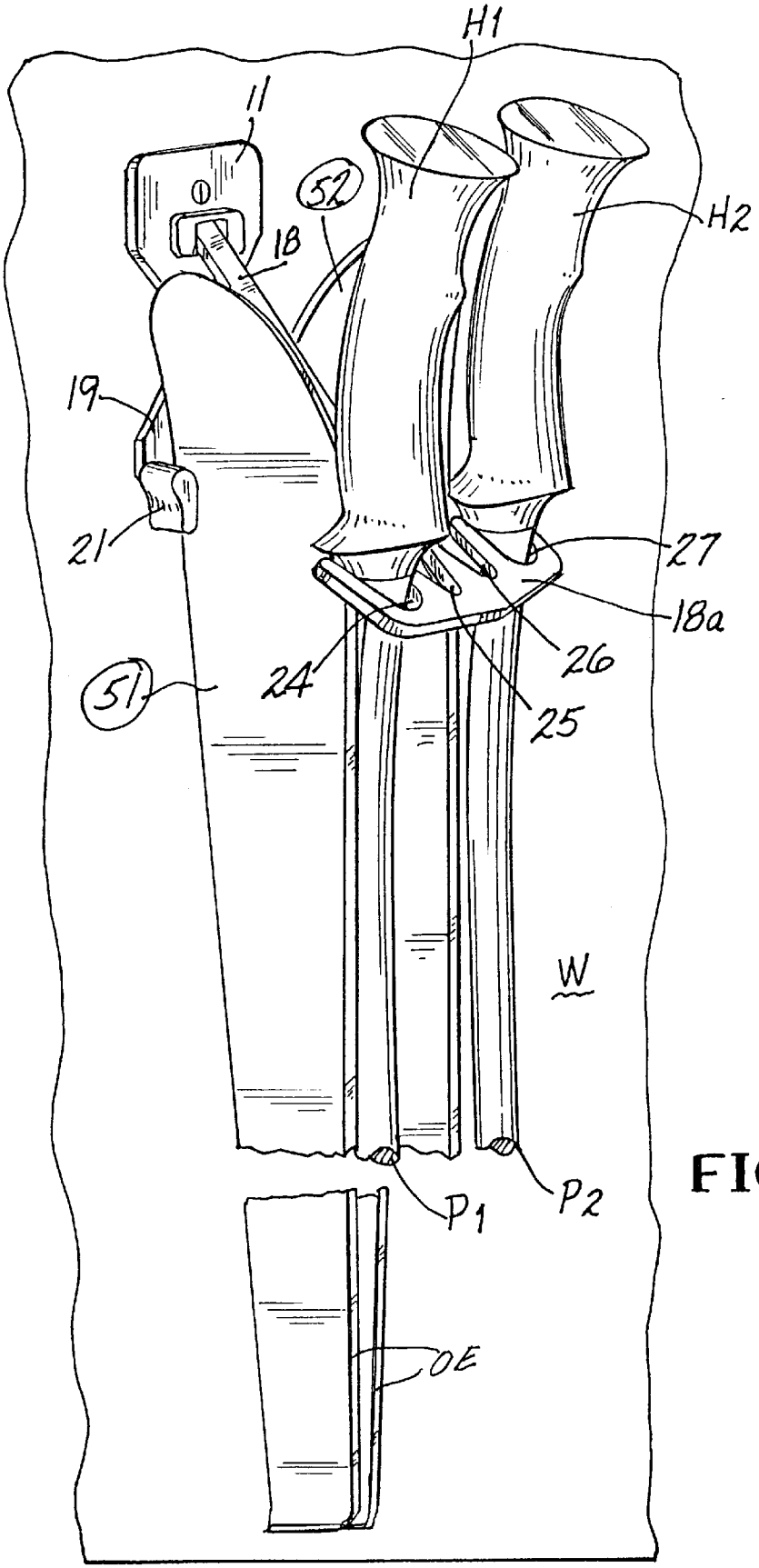
FIG. 5 is a perspective view of the device of FIG. 1 showing the device mounted to a wall and supporting and retaining a pair of skis and ski poles.

The device 10 is shown mounted to a wall W in FIG. 5 and supporting a pair of skis S1 and S2, a pair of ski poles P1 and P2 having hand grips H1 and H2 respectively on the upper ends thereof.

In use, arm 18 of member 12 is pivoted upwardly sufficiently to permit the skis S1 and S2, which are interlocked at the brakes, to be placed on and supported on lugs 21 and 22. Then, member 12 is released to drop and receive the skis in recesses 25 and 26 at which time the bottom edges defining recesses 25 and 26 engage the outer edges of skis S1 and S2 and exert a retaining force thereon, holding the skis on support lugs 21 and 22. Then, the poles P1 and P2 are placed in recesses 24 and 27.

The recesses 24 and 27 are dimensioned to receive poles P1 and P2 with fingers 28 and 31 supporting pole P1 at the bottom of hand grip H1 and fingers 29 and 32 supporting pole P2 at the bottom of grip H2.

Arm 18 is longitudinally dimensioned to permit the skis to be mounted to support lugs when in an essentially horizontal position. Then when arm 18 is released the outer edges of skis S1 and S2 are engaged by the edges 25*a* and 26*a* defining recesses 25 and 26, respectively.

Arm 18 will extend below the horizontal, as shown in FIG. 5, and cross portion 18*a* will hold the skis S1 and S2 on support lugs 21 and 22.

In the case of narrow skis the edges 25*a* and 26*a* of recesses 25 and 26 may not actually contact the outer edges of the skis S1 and S2, but are sufficiently close so that engagement will be made if the skis tend, for any reason, to move or be moved off of support lugs 21 and 22.

Then poles P1 and P2 may be inserted into recesses 24 and 27 and supported on fingers 31, 28, 29 and 32 as previously described. The weight of the poles contributes to urging retaining member 12 downwardly and retaining skis S1 and S2 on support lugs 21 and 22.

The support lugs 21 and 22 extend outwardly from arms 19 and 20 only a small dimension. Prototypes having lugs extending only nine-sixteenths inch (9/16') have successfully supported all types of skis, including bevel edge skis. It has been determined that only about one-eighth inch (1/8') of contact of the skis on support lugs 21 and 22 is necessary with retainer member up. Bevel edge skis will require about one-quarter inch of support contact.

A device embodying the invention may be wall mounted easily at any desired height and will securely support and retain a pair of skis and a pair of ski poles.

The members 11 and 12 may be molded of polypropylene which is of low cost and substantial strength. Another suitable material is a product of the General Electric Company known as Xenoy.

It may thus be seen that the objects of the invention set forth above as well as those made apparent are efficiently attained. While a preferred embodiment of the invention has been set forth for purposes of disclosure, other embodiments as well as modifications to the disclosed embodiment may occur to others skilled in the art. Accordingly, the appended claims are intended to cover all embodiments of the invention which do not depart from the spirit and scope of the invention.

What is claimed is:

1. A support device for a pair of skis having arcuately upturned leading tips which join the following portion of the ski where the skis are in bottom-to-bottom relation, a base member adapted to be secured to a vertical surface, said base member having downwardly extending spaced apart arms, a short outstanding ski support lug on the lower portion of each of said arms, a retaining member having an elongated leg with an integral hinge pin at one end thereof and a cross arm at the other end thereof, said base member defining a bearing therein above said spaced apart arms for receiving said hinge pin, said hinge pin being captured in said bearing when said base member is mounted to a vertical surface, said lugs on said base member being spaced apart a distance such that said lugs on said base member engage the arcuate leading tips of a pair of bottom-to-bottom skis, said leg of said retaining member fitting between said arms and in a non-operative position hanging vertically, said retaining member being pivotal in said bearing to a substantially horizontal position to permit a pair of skis in bottom-to-bottom relationship to be mounted on said lugs for support thereon and then pivoted downwardly for said cross arm to engage the edges of the skis away from the vertical surface and retain a supported pair of skis on said lugs.

2. The support device of claim 1 where the cross arm of said retaining member has first recesses defined therein on either side of said leg which receive the edges of the skis.

3. The support member of claim 2 wherein said cross arm has second recesses therein outside of said first recesses for receiving and supporting ski poles therein.

4. The support member of claim 3 wherein said first and second recesses are defined by said leg and fingers on said cross arm extending toward said leg.

5. The support device of claim 1 where said arms on said base member diverge outwardly toward the free ends thereof to provide a predetermined spacing between said support lugs.

* * * * *